US006796442B1

(12) United States Patent
Wu

(10) Patent No.: US 6,796,442 B1
(45) Date of Patent: Sep. 28, 2004

(54) TOWEL RACK FORMED OF PARTS THAT ARE DETACHABLY FITTED TOGETHER

(76) Inventor: Feng-Chung Wu, No. 3, Lane 240, Chung Cheng Rd. Yuan Lin Township, Chang Hua Hsien (TW)

( * ) Notice: Subject to any disclaimer, the term of this patent is extended or adjusted under 35 U.S.C. 154(b) by 0 days.

(21) Appl. No.: 10/327,394

(22) Filed: Dec. 24, 2002

(51) Int. Cl.[7] ..... A47F 5/00
(52) U.S. Cl. ..... 211/105.1; 248/201; 248/251
(58) Field of Search ..... 211/105.1, 87.01; 248/201, 251

(56) References Cited

U.S. PATENT DOCUMENTS 2,146,654 A * 2/1939 Shea et al.
4,981,276 A * 1/1991 Agor et al. ..... 248/251 X
5,186,427 A * 2/1993 Semchuck ..... 248/251
5,875,903 A * 3/1999 Chen ..... 211/105.1
6,012,692 A * 1/2000 Meck ..... 248/251
6,199,808 B1 * 3/2001 Lin ..... 211/105.1 X
6,364,264 B1 * 4/2002 Lai ..... 211/105.1 X
6,371,423 B1 * 4/2002 Miller
6,595,478 B2 * 7/2003 Lee ..... 248/251 X

* cited by examiner

*Primary Examiner*—Robert W. Gibson, Jr.

(57) ABSTRACT

A towel rack includes a hanging rod which is used to hold towels and is fastened to a wall surface by two support mounts. The hanging rod is detachably fastened to the two support mounts by two fastening bolts in conjunction with two fastening bars and two connection rods.

2 Claims, 5 Drawing Sheets

TOWEL RACK FORMED OF PARTS THAT ARE DETACHABLY FITTED TOGETHER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

1. Field of the Invention

The present invention relates generally to a towel rack, and more particularly to a towel rack comprising parts which are detachably fastened together.

2. Background of the Invention

As shown in FIG. 4, a prior art towel rack comprises a hanging rod 70 and two fastening mounts 71. In light of the two fastening mounts 71 being identical in construction to each other, only one fastening mount 71 is shown in the drawing. The two fastening mounts 71 are fixed with a wall to support the hanging rod 70 which is used to hold one or more towels. The hanging rod 70 and the fastening mounts 71 are fixedly fastened together by solder patches 75. Similarly, another prior art towel rack comprises a hanging rod 72, two fastening mounts 73, and two sleeves 74 which are fitted respectively over two longitudinal ends of the hanging rod 72 and are fixedly fastened with the fastening mounts 73 by solder patches 75, as shown in FIG. 5.

Such prior art towel racks as described above share the following shortcomings. In the first place, they cannot be conveniently stored or packaged for shipment in view of the fact that their component parts are fixedly fastened together by soldering. Secondly, the solder patches 75 undermine the esthetic effect of the prior art towel racks and do not hold for a protracted period of time, thereby shortening the service life span of the prior art towel racks.

BRIEF SUMMARY OF THE INVENTION

The primary objective of the present invention is to provide a towel rack free of the shortcomings of the prior art towel racks described above.

In keeping with the principle of the present invention, the foregoing objective of the present invention is attained by a towel rack comprising a hanging rod, two fastening bars, two connection rods, two support mounts, and two fastening bolts by which the hanging rod, the two fastening bars, the two connection rods, and the two support mounts are detachably fastened together. The hanging rod is used to hold towels and is fastened to a wall by the two support mounts. In light of the component parts of the towel rack being detachably fastened together, the towel rack can be easily stored or packaged for shipment.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
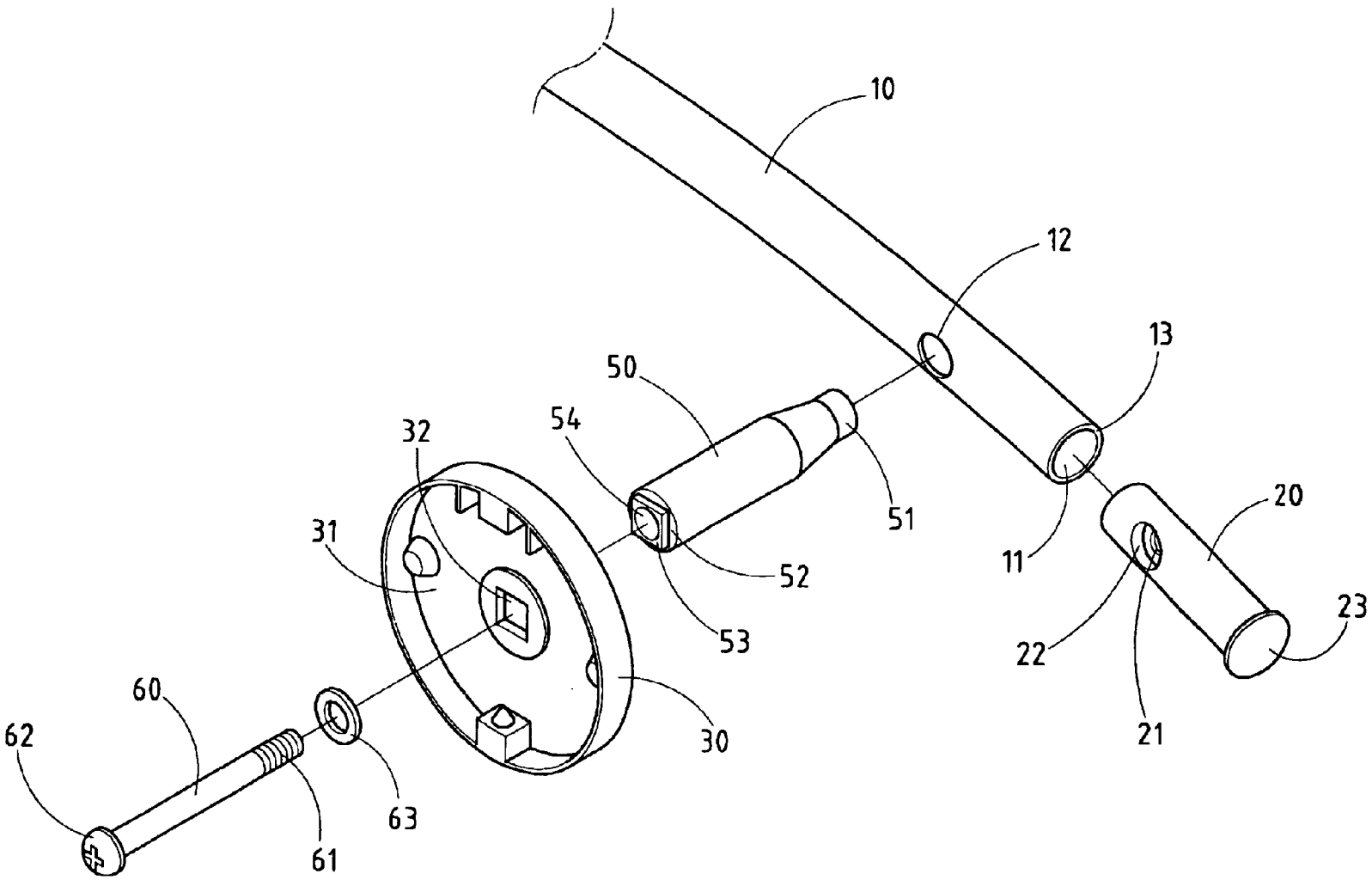
FIG. 1 shows a partial exploded perspective view of the preferred embodiment of the present invention.
Figure 2:
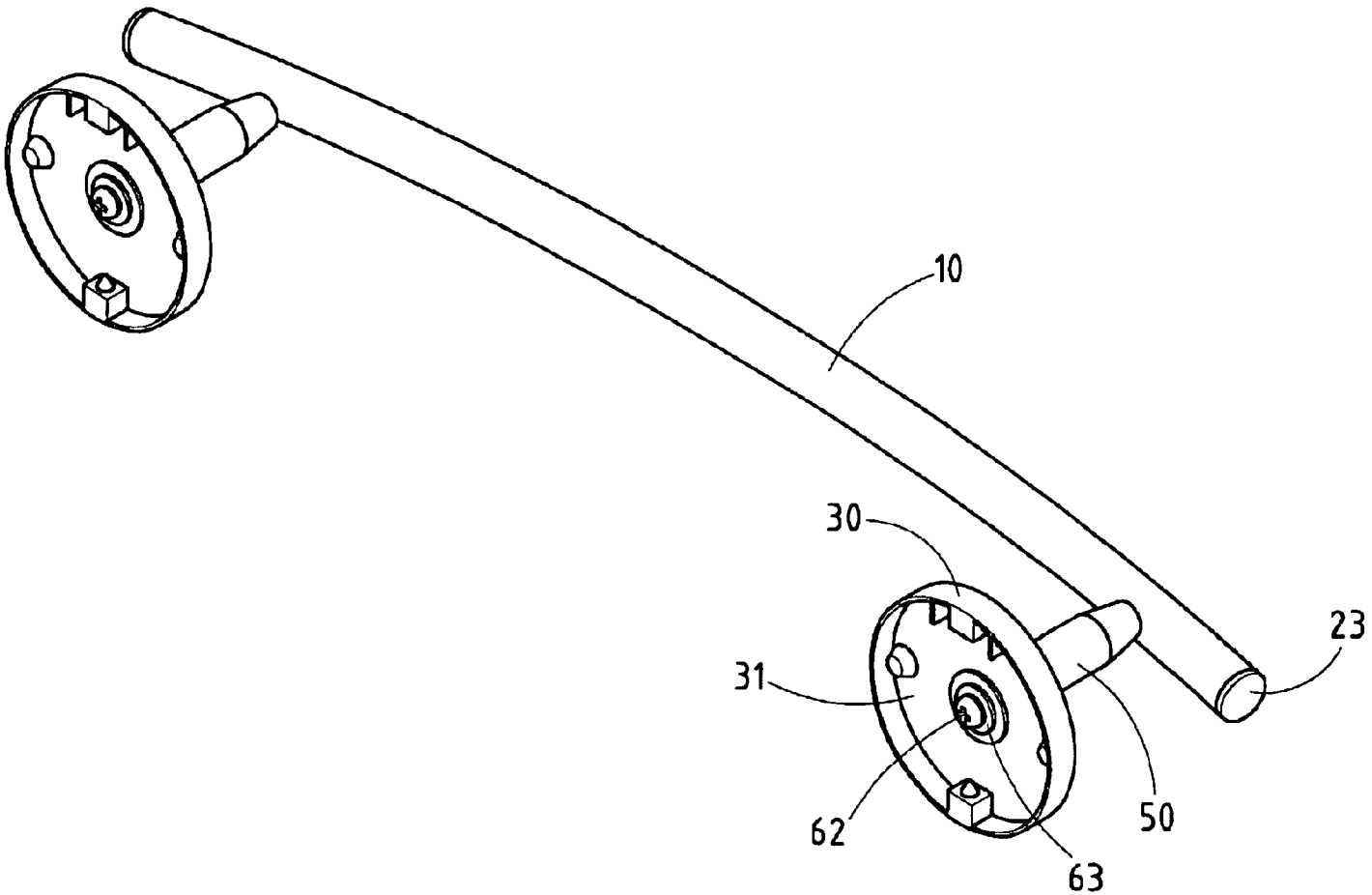
FIG. 2 shows a full perspective view of the preferred embodiment of the present invention.
Figure 3:
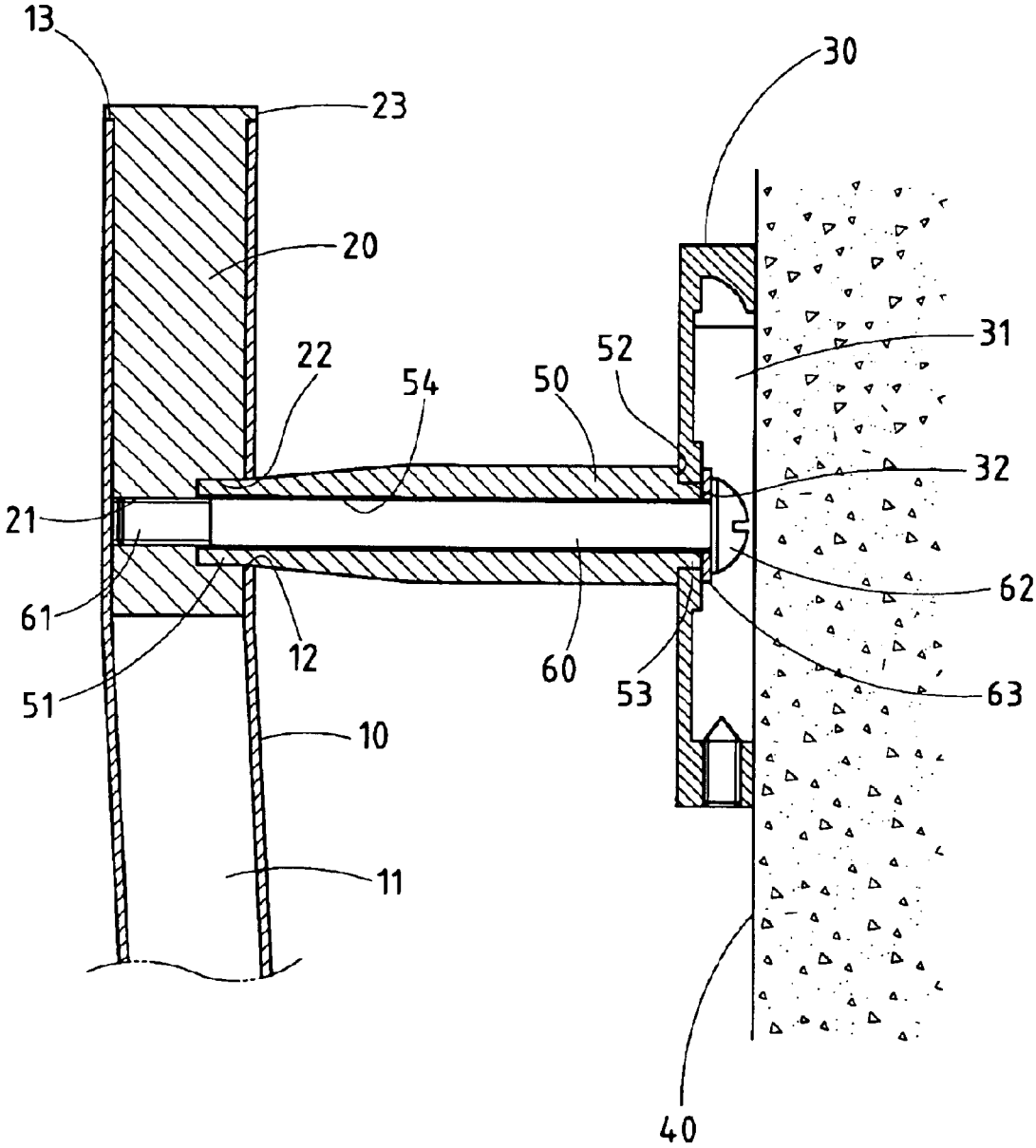
FIG. 3 shows a partial sectional view of the preferred embodiment of the present invention.
Figure 4:
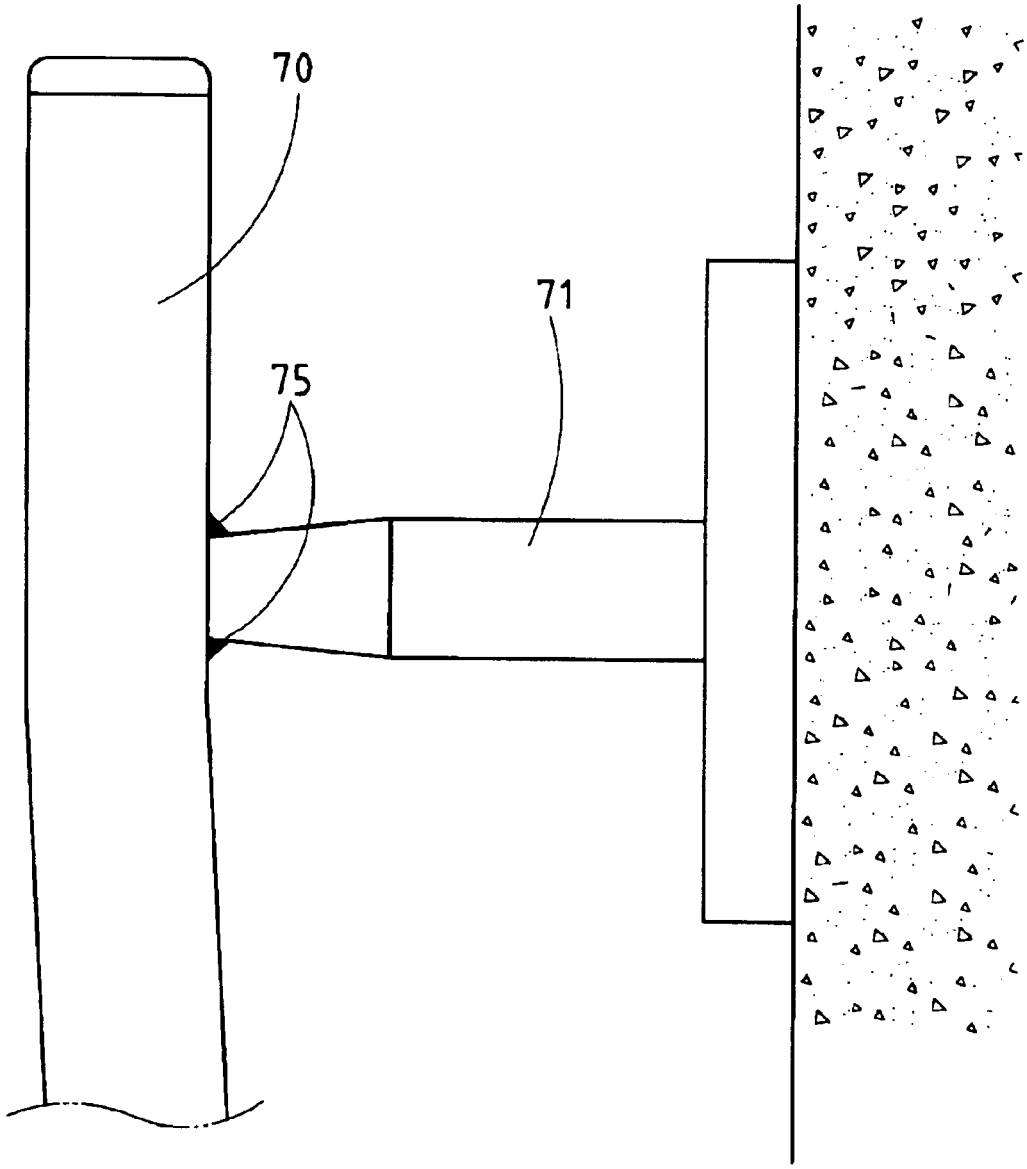
FIG.4 PRIOR ART
FIG. 4 shows a partial top view of a prior art towel rack whi fastened to a wall surface.
Figure 5:
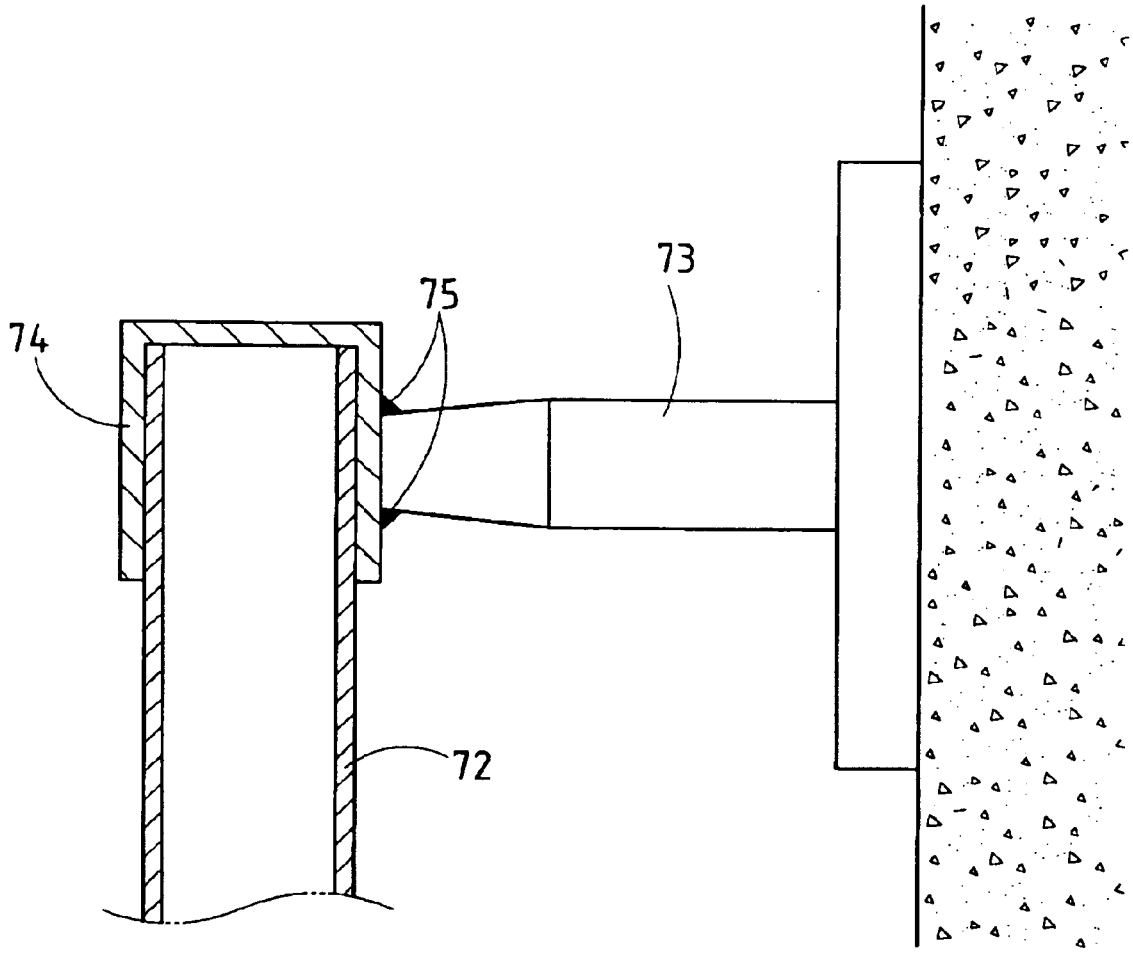
FIG.5 PRIOR ART
FIG. 5 shows a partial top view of another prior art towel which is fastened to a wall surface.

As shown in FIGS. 1–3, a towel rack embodied in the present invention comprises a hanging rod 10, two fastening bars 20, two support mounts 30, two connection rods 50, and two fastening bolts 60.

The hanging rod 10 is provided in two longitudinal ends 13 with a locating slot 11 of a predetermined length and extending along the longitudinal direction of the hanging rod 10. The locating slot 11 is provided in the longitudinal side wall of proximity of an inner end thereof with a through hole 12 which is perpendicular to the longitudinal direction of the hanging rod 10 and is in communication with the locating slot 11. The hanging rod 10 is used to hold towels.

The two fastening bars 20 are identical to each other and are corresponding in length to the locating slots 11 of the hanging rod 10. The two fastening bars 20 are provided in the outer wall of proximity of an inner end with a threaded hole 21 of a predetermined depth. The threaded hole 21 is provided in the inner wall of the outer end thereof with a stop edge 22. The two fastening bars 20 are further provided at the outer end with a flange 23. The two fastening bars 20 are dimensioned to fit removably into the locating slots 11 of the hanging rod 10 such that the threaded hole 21 of the fastening bars 20 is aligned with the through hole 12 of the hanging rod 10, and that the flange 23 is stopped by the longitudinal end 13.

The connection rods 50 have a predetermined length, an outer end 51, an inner end 52, and a longitudinal through hole 54. The outer end 51 is removably fitted into the through hole 12 of the hanging rod 10 such that the outer end 51 is stopped by the stop edge 22 of the outer end of the threaded hole 21 of the fastening bar 20.

The support mounts 30 are provided in the center of a body wall 31 with a through hole 32 and are respectively fastened with the inner end 52 of the connection rod 50 by one of the two fastening bolts 60 in conjunction with a washer 63. The fastening bolts 60 have a threaded end 61, which is engaged with the threaded hole 21 of the fastening bar 20 via the longitudinal through hole 54 of the connection rod 50 and the through hole 12 of the hanging rod 10. The fastening bolts 60 further have a head 625 which is pressed against the washer 63, as shown in FIG. 3. The support mounts 30 are fastened at an interval to a wall surface 40.

In order to prevent the fastening mounts 30 from turning in relation to the inner end 52 of the connection rods 50, the through hole 32 of the support mounts 30 has a square shape. Accordingly, the inner end 52 of the connection rods 50 is provided with a square raised portion 53 which is penetrated by the inner end of the longitudinal through hole 54 of the connection rod 50 and is dimensioned to fit into the square through hole 32 of the support mounts 30.

It is readily apparent that the hanging rod 10, the fastening bars 20, the connection rods 50, and the support mounts 30 are detachably fastened together by the two fastening bolts 60. In another word, the towel rack of the present invention can be easily separated by unfastening the fastening bolts 60.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A towel rack comprising:

a hanging rod having an inside formed with a locating slot extending in a longitudinal direction of said hanging rod and having two longitudinal ends each formed with a through hole communicating with said locating slot;

two fastening bars each mounted in a respective one of the two longitudinal ends of said hanging rod and having a first end formed with a threaded hole and a second end formed with a flange rested on the respective longitudinal end of said hanging rod, said threaded hole of each of said two fastening bars having a side formed with a stop edge aligning with said respective through hole of said hanging rod;

two connection rods each mounted on a respective one of the two longitudinal ends of said hanging rod and each having a first end extended through said respective through hole of said hanging rod and rested on said stop edge of a respective one of said two fastening bars, each of said two connection rods having an inside formed with a longitudinal through hole;

two support mounts each mounted on a second end of a respective one of said two connection rods and each having an inside formed with a through hole; and two fastening bolts each extended through said through hole of a respective one of said two support mounts, said longitudinal through hole of a respective one of said two connection rods and each screwed into said threaded hole of a respective one of said two fastening bars, so that said hanging rod, each of said two fastening bars, each of said two connection rods and each of said two support mounts are combined with each other.

2. The towel rack as claimed in claim 1, wherein said through hole of each of said two support mounts has a square shape, and the second end of each of said two connection rods is formed with a square raised portion inserted into said square through hole of a respective one of said two support mounts.

* * * * *